US009186722B2

(12) United States Patent
Morikawa et al.

(10) Patent No.: US 9,186,722 B2
(45) Date of Patent: Nov. 17, 2015

(54) TILT TYPE GRAVITY MOLDING DEVICE

(71) Applicant: Morikawa Kanagata Co., Ltd., Osaka (JP)

(72) Inventors: Shunichi Morikawa, Osaka (JP); Tadayuki Yano, Osaka (JP)

(73) Assignee: MORIKAWA KANAGATA CO., LTD., Osaka (JP)

( * ) Notice: Subject to any disclaimer, the term of this patent is extended or adjusted under 35 U.S.C. 154(b) by 0 days.

(21) Appl. No.: 14/360,964

(22) PCT Filed: Feb. 25, 2014

(86) PCT No.: PCT/JP2014/054438

§ 371 (c)(1),
(2) Date: May 28, 2014

(87) PCT Pub. No.: WO2015/128927

PCT Pub. Date: Sep. 3, 2015

(65) Prior Publication Data

US 2015/0239042 A1 Aug. 27, 2015

(51) Int. Cl.

| | |
|---|---|
| ***B22D 23/00*** | (2006.01) |
| ***B22D 18/04*** | (2006.01) |
| ***B22D 35/04*** | (2006.01) |
| ***B22D 41/04*** | (2006.01) |
| ***B22D 27/00*** | (2006.01) |

(52) U.S. Cl.

CPC ..... *B22D 18/04* (2013.01); *B22D 23/006* (2013.01); *B22D 27/003* (2013.01); *B22D 35/04* (2013.01); *B22D 41/04* (2013.01)

(58) Field of Classification Search

CPC ..... B22D 23/006; B22D 39/026

See application file for complete search history.

(56) References Cited

U.S. PATENT DOCUMENTS 5,067,552 A * 11/1991 Petrushka ..... 164/259

FOREIGN PATENT DOCUMENTS

| | | |
|---|---|---|
| JP | 2012-024807 | 2/2012 |
| WO | 2011/089711 A1 | 7/2011 |

OTHER PUBLICATIONS

International Search Report and Written Opinion for PCT/JP2014/054438.

English translation of abstract of WO 2011/089711 A1 (published Jul. 28, 2011).

English translation (by machine) of JP 2012-024807 (published Feb. 9, 2012).

* cited by examiner

*Primary Examiner* — Kevin P Kerns
*Assistant Examiner* — Steven Ha
(74) *Attorney, Agent, or Firm* — McClure, Qualey & Rodack, LLP

(57) ABSTRACT

Provided is a tilt type gravity molding device which requires no riser, prevents increase in length of a sprue runner, suppresses occurrence of clogging of a molten metal, and facilitates temperature control of the molten metal. The tilt type gravity molding device includes: a mold having defined therein a product forming space for forming a molded product, and configured to receive a molten metal from a pouring gate; a ladle including: a storing section capable of storing the molten metal therein; and a plate-like opening/closing body abutting on the mold, and having an injection port capable of being aligned with the pouring gate; and a gas supplying section for supply gas into the product forming space. The ladle is slidably mounted to the mold, and is slidable between an opening state in which the injection port is aligned with the pouring gate, and a closing state in which the plate-like opening/closing body closes the pouring gate.

6 Claims, 10 Drawing Sheets

TILT TYPE GRAVITY MOLDING DEVICE

TECHNICAL FIELD

The present invention relates to a molding device for forming a molded product by pouring a molten metal into a product forming space defined in an inside of a mold, and more particularly, to a tilt type gravity molding device for obtaining a molded product by pouring a molten metal into a product forming space due to a self-weight of the molten metal, and then solidifying the molten metal.

BACKGROUND ART

A gravity molding device for molding a product by pouring a molten metal only due to gravity of the molten metal into a mold from a pouring gate provided at an upper portion of the mold can increase a cooling rate at the time of molding, and can produce a precise molded product excellent in a molded surface and dimension accuracy. The product is excellent particularly in pressure resistance and mechanical property. However, the gravity molding device requires that a riser for compensating decrease in volume of the molten metal at the time of solidification be formed at an upper portion of the molded product, and that a period of time to cool and solidify the riser be secured in addition to a period of time to solidify the molded product. Further, the formation of the riser needs more amount of the molten metal and higher cost of melting, and also needs extra process cost of cutting the riser. In addition, in order to obtain the molded product having no shrinkage cavity, the molten metal needs to be directionally solidified toward the riser from a bottom side of a space in the mold. However, the mere formation of the riser does not solve a problem in that solidification timing of the molten metal cannot be controlled sufficiently.

In this context, as illustrated in FIG. 10, the inventor of the subject application proposes a tilt type gravity molding device 100 including a closing portion 102 capable of opening/closing a sprue runner 101, and a gas supplying section 104 capable of supplying gas into a product forming space 103 (Patent Literature 1). In the tilt type gravity molding device 100, after pouring a molten metal 105 into the product forming space 103, the closing portion 102 that slides horizontally closes the sprue runner 101, and the gas supplying section 104 supplies the gas into a mold 106. In this way, the molten metal 105 contained in the mold 106 can be pressurized by the gas. The tilt type gravity molding device 100 pressurizes the molten metal 105 by the gas into the product forming space 103 in the mold 106, and thus causes no shrinkage cavity and no crack even in a case where the riser is not substantially provided. Therefore, the tilt type gravity molding device 100 does not need the period of time to cool and solidify the riser, and thus can shorten a cycle of a molding time period and reduce manufacturing cost of the molded product. Further, the tilt type gravity molding device 100 can provide effects of reducing an amount of the molten metal for forming the riser, cost of melting, and process cost of cutting the riser.

CITATION LIST

Patent Literature

[PTL 1] WO 2011/089711

SUMMARY OF INVENTION

Technical Problem

By the way, as illustrated in FIG. 10, the closing portion 102 of the tilt type gravity molding device 100 disclosed in Patent Literature 1 forms a part of the sprue runner 101 at a midway point in an up-and-down direction of the sprue runner 101 extending substantially vertically, and horizontally slides to close the sprue runner 101. Therefore, when the closing portion 102 closes the sprue runner 101, a space of the closing portion 102 forming the sprue runner 101 is closed hermetically, and the remaining molten metal 105 is solidified, which easily causes a problem such as clogging of the molten metal. Further, the sprue runner 101 is formed above the closing portion 102, and hence a length between a ladle 107 and a space in the mold 106 is increased, which causes a problem in that temperature control of the molten metal 105 and adjustment of an amount of the molten metal are difficult.

Therefore, it is an object of the present invention to provide a tilt type gravity molding device which requires no riser, prevents increase in length of a sprue runner, suppresses occurrence of clogging of the molten metal, and facilitates temperature control of the molten metal.

Solution to Problem

A tilt type gravity molding device according to a first aspect of the present invention includes: a mold having defined therein a product forming space for forming a molded product, and configured to receive a molten metal from a pouring gate; a ladle including: a storing section capable of storing the molten metal therein; and a plate-like opening/closing body abutting on the mold, and having an injection port capable of being aligned with the pouring gate; and a gas supplying section for supply gas into the product forming space. The ladle is slidably mounted to the mold, and is slidable between an opening state in which the injection port is aligned with the pouring gate, and a closing state in which the plate-like opening/closing body closes the pouring gate.

In a tilt type gravity device according to a second aspect of the present invention, the gas supplying section includes a gas passage through which the gas is supplied into an upper space of the product forming space from an outside of the mold, and the gas passage is horizontally communicated to the upper space.

In a tilt type gravity device according to a third aspect of the present invention, the gas passage includes: an introducing passage through which the gas is introduced from the outside of the mold, the introducing passage being communicated to the outside of the mold; and a supplying passage through which the gas is supplied into the upper space of the product forming space, the supplying passage branching from the introducing passage.

Advantageous Effects of Invention

According to the tilt type gravity molding device of the first aspect of the present invention, the ladle includes the opening/closing body in which the injection port is formed on a surface abutting on the mold. The ladle is slid on the mold, and thus the ladle can be shifted between the opening state in which the injection port is aligned with the pouring gate, and the closing state in which the opening/closing body closes the pouring gate. Therefore, when the mold is tilted and the molten metal stored in the storing section of the ladle is poured into the product forming space defined in the mold, the mold is tilted in the opening state in which the injection port is aligned with the pouring gate, and thus the molten metal can be poured from the injection port through the pouring gate into the product forming space. Further, when supplying the gas into the product forming space after pouring the molten metal into the product forming space, the ladle is slid, and the gas is supplied after the opening/closing body is shifted to the closing state of closing the pouring gate. Thus, without leakage of the gas to the outside, the molten metal contained in the product forming space can be pressurized. In this way, the opening/closing body provided to the ladle can open/close the pouring gate, and hence compared with a case of separately providing a device of opening/closing a sprue runner, the pouring gate can be closed reliably with simpler structure. As a result, it is possible to suppress occurrence of clogging of the molten metal that may be caused by the molten metal remaining in the sprue runner. In addition, compared with a case of separately providing an opening/closing device to the sprue runner, a length of the sprue runner can be reduced. Thus, it is possible to prevent reduction in temperature of the molten metal, and to further facilitate temperature control of the molten metal. Further, the sprue runner is reduced in length. Thus, the molten metal can be prevented from remaining in the sprue runner, and an amount of the molten metal can be controlled easily.

According to the tilt type gravity molding device of the second aspect of the present invention, through the gas passage of the gas supplying section, the gas is supplied into the upper space of the product forming space defined in an inside of the mold, and the gas passage is horizontally communicated to the upper space. Thus, the gas is not jetted directly to the molten metal stored in the product forming space defined in the inside of the mold. Therefore, it is possible to prevent a dent of the molten metal that may be caused by jetting of the gas.

According to the tilt type gravity molding device of the third aspect of the present invention, the gas passage includes: the introducing passage through which the gas is introduced from the outside of the mold, the introducing passage being communicated to the outside of the mold; and the supplying passage through which the gas is supplied into the upper space of the product forming space, the supplying passage branching from the introducing passage. Therefore, the gas is caused to flow into one introducing passage, and thus, through a plurality of branched passages of the supplying passage, the gas can be supplied at the same pressure into the upper space defined in the inside of the mold, with the result that adjustment of a flow rate and pressure of the gas can be facilitated.

DESCRIPTION OF EMBODIMENT

Figure 1:
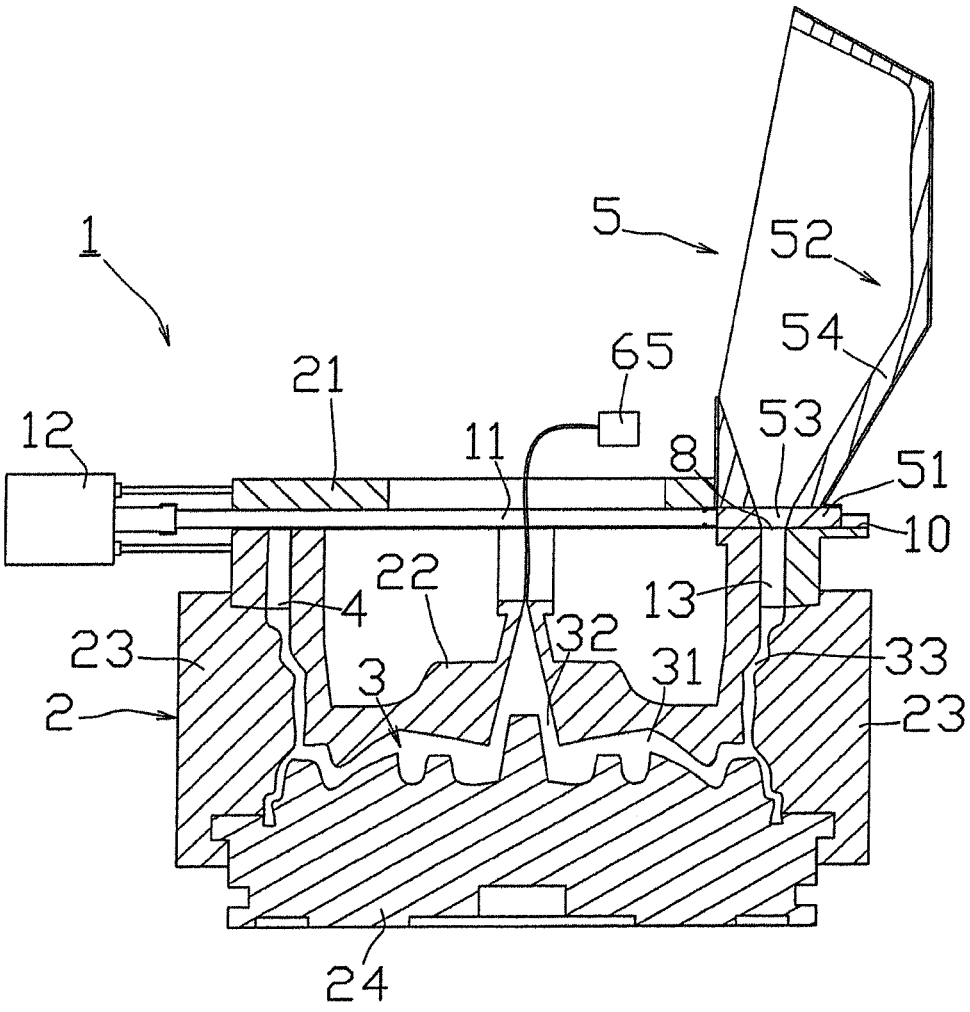
FIG. 1 is a sectional view illustrating a configuration of a tilt type gravity molding device in a standing state.

Now, a tilt type gravity molding device 1 according to an exemplary embodiment of the present invention is described with reference to the drawings. In this embodiment, although the tilt type gravity molding device 1 for molding a tire wheel formed of an aluminum alloy is described as an example, the tilt type gravity molding device 1 may mold another member such as an engine cylinder of an automobile. The tilt type gravity molding device 1 defines, by coupling a plurality of disassemblable metal members through use of a hydraulic cylinder, a product forming space 3 that forms a molded product 9. The tilt type gravity molding device 1 includes a mold 2 which can be tilted between a laid state and a standing state of being raised by approximately 90 degrees from the laid state, a ladle 5 which stores a molten metal 7 such as an aluminum alloy, and pours the molten metal 7 into the product forming space 3 through a pouring gate 8 when the mold 2 is tilted, and a gas supplying section 6 for supplying gas into an upper space 4 of the product forming space 3. In the following description, unless otherwise mentioned, the tilt type gravity molding device 1 is described with reference to the standing state as illustrated in FIG. 1. An up-and-down direction and a horizontal direction refer to the up-and-down direction and the horizontal direction in a case where the mold 2 is kept in the standing state. Note that, the standing state refers to a state in which the pouring gate 8 is open upward, and refers to a state in which the molten metal 7 stored in the ladle 5 is poured into the mold 2 through the pouring gate 8. Further, the laid state refers to a state in which the pouring gate 8 is horizontally open, and refers to a state in which the molten metal 7 stored in the ladle 5 remains in the ladle 5.

The mold 2 is formed by fitting together an upper die 21, a lower die 22, a middle die 23, and a side die 24 that can be divided into four members. In an inside of the mold 2, the product forming space 3 is defined. The product forming space 3 is filled with the molten metal 7, for forming the molded product 9 as a tire wheel. The product forming space 3 includes a disc forming portion 31 for forming a disc, a hub hole forming portion 32 which is formed in a center of the disc forming portion 31 and formed to be thick so as to form a hub hole, and a rim forming portion 33 which is formed into an annular shape along an outer periphery of the disc forming portion 31 so as to form a rim. Movement of the upper die 21, the lower die 22, the middle die 23, and the side die 24 is controlled by a hydraulic jack (not shown). When the dies form the mold 2, the hydraulic jack is controlled so as to fit the dies 21, 22, 23, and 24 closely to each other. Further, the mold 2 is fixed to a tilting device (not shown) together with the hydraulic jack, and can be tilted to at least 90 degrees.

Figure 6:
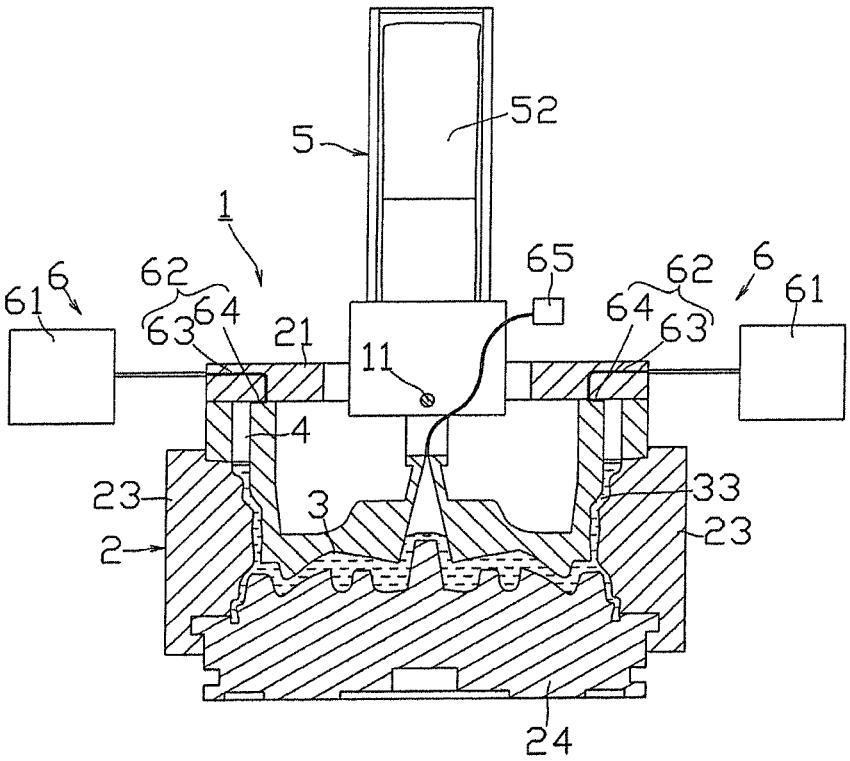
FIG. 6 is a sectional view of a configuration of the tilt type gravity molding device, for illustrating a configuration of a gas supplying section.
Figure 7:
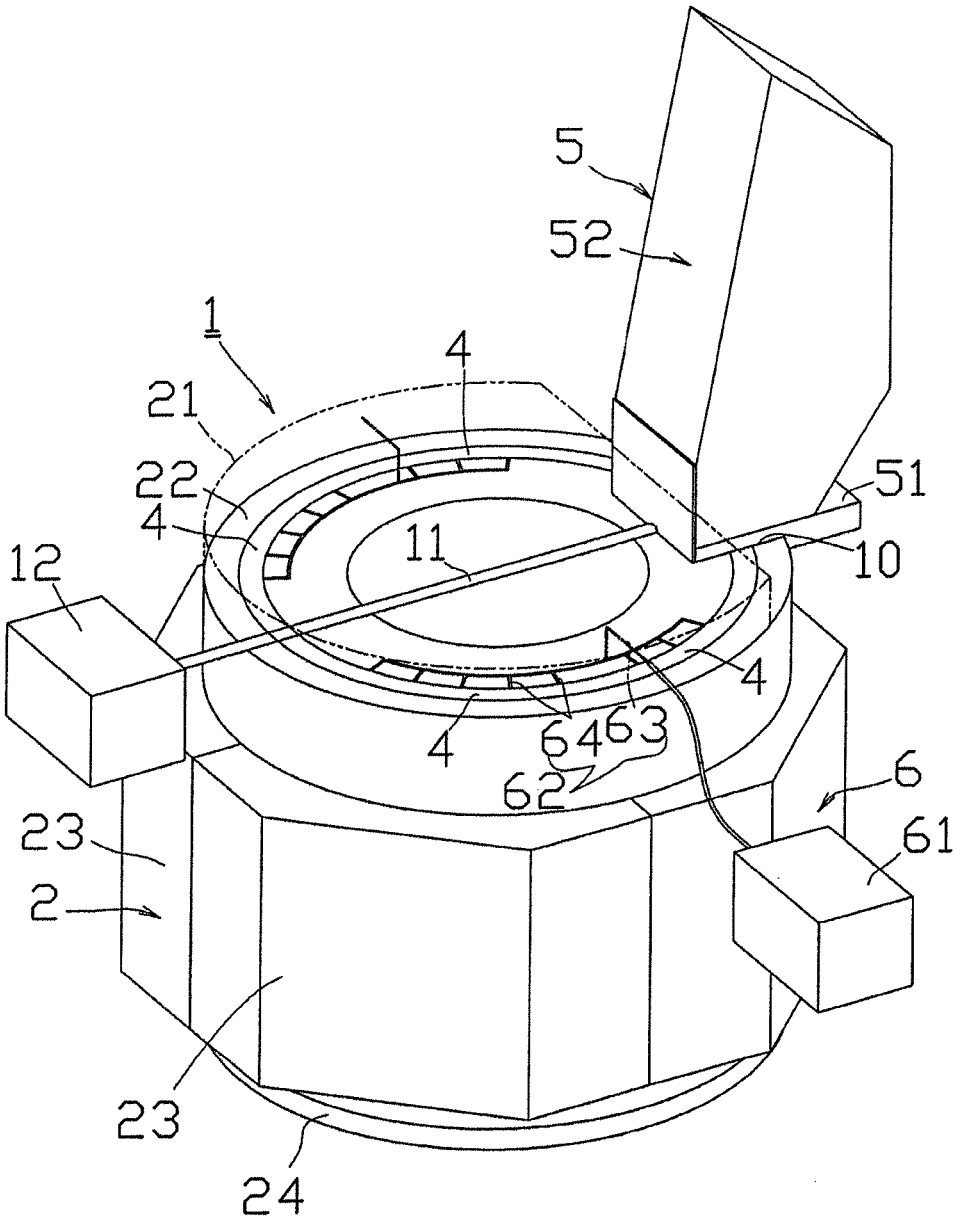
FIG. 7 is a perspective view of the tilt type gravity molding device, for illustrating the gas supplying section and an upper surface shape of a middle die with an upper die indicated by the chain double-dashed line.
Figure 8:
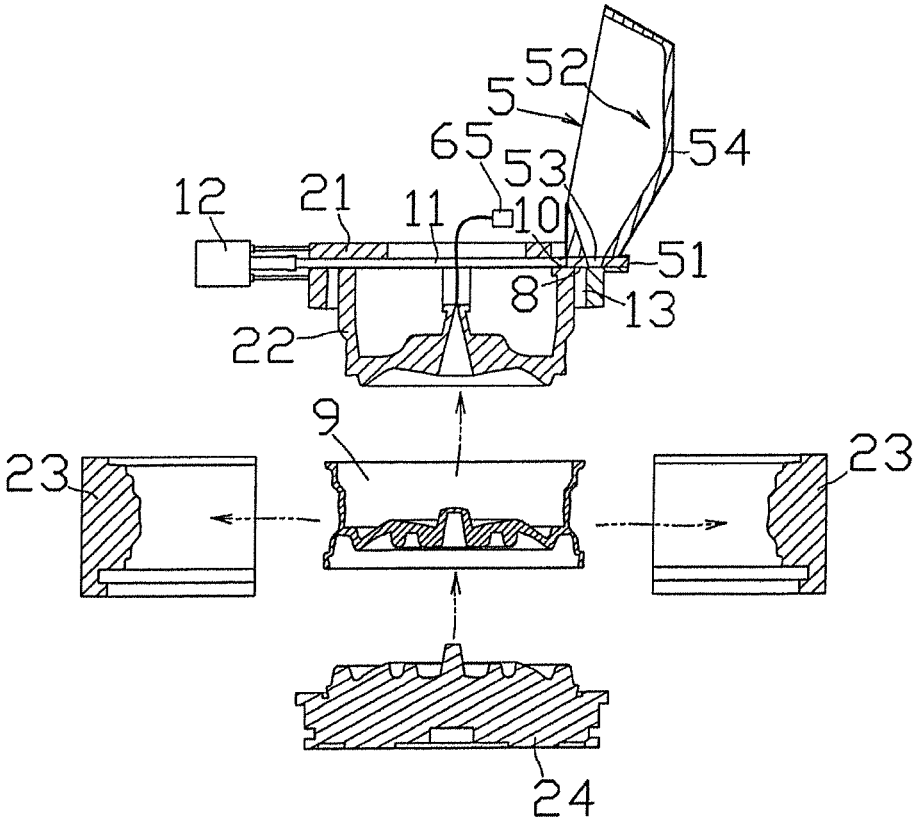
FIG. 8 is a sectional view illustrating a state in which a mold is released from a molded product.

As illustrated in FIGS. 6 and 8, the upper die 21 has such an annular shape that an upper end portion of the upper space 4 of the product forming space 3 is provided on a lower surface of the upper die 21. As illustrated in FIGS. 6 and 7, in the upper die 21, there is formed an introducing passage 63 through which gas for pressurizing an inside of the product forming space 3 is introduced from an outside of the mold.

As illustrated in FIG. 1, the middle die 23 is formed into such a cup-like shape that its outer surface forms a shape of an inner peripheral surface of a rim of a tire wheel and a shape of an inner side surface of a disc. The pouring gate 8 through which the molten metal 7 can be poured is formed in an upper surface of the middle die 23. A plate-like opening/closing body 51 formed on a lower surface of the ladle 5 abuts on a portion of the middle die 23 in which the pouring gate 8 is provided. A slide groove 10 is formed in the middle die 23 so as to allow the opening/closing body 51 to slide. A supplying passage 64 through which the gas is supplied into the upper space 4 of the product forming space 3 is grooved in the upper surface of the middle die 23.

The gas supplying section 6 includes a pump 61 for supplying high-pressure gas into a gas passage 62, and the gas passage 62 through which the high-pressure gas flowing from the pump 61 is introduced into the upper space 4 of the product forming space 3 defined in the inside of the mold. The pump 61 can apply pressure to the high-pressure gas into the gas passage, and can apply negative pressure by sucking the gas contained in the gas passage. When the upper die 21 and the middle die 23 are combined together, the introducing passage 63 of the upper die 21 and the supplying passage 64 of the middle die 23 are communicated to each other to form the gas passage 62. As described above, the pump 61 supplies the high-pressure gas into the upper space 4 of the product forming space 3, and thus pressurizes the molten metal stored in the product forming space 3. Thus, it is possible to prevent occurrence of a problem such as a shrinkage cavity that may be caused by solidification shrinkage of the molten metal. The supplying passage 64 branches into a plurality of passages, and ends of the branched passages are horizontally communicated to the upper space 4 of the product forming space 3. In this way, in the gas passage 62, the high-pressure gas introduced by the pump 61 into the introducing passage 63 from the outside is divided into the plurality of passages in the supplying passage 64 and horizontally supplied into the upper space 4 of the product forming space 3, and thus the gas is not jetted directly to the molten metal 7 stored in the product forming space 3 positioned below the upper space 4. Therefore, it is possible to prevent a dent of the molten metal 7 that may be caused by jetting of the gas. Further, the gas passes through the plurality of passages of the supplying passage 64, and thus can be supplied at the same pressure into the upper space 4 defined in the inside of the mold, with the result that adjustment of a flow rate and pressure of the gas can be facilitated. Note that, in this embodiment, a center pump 65 for supplying the gas into the hub hole forming portion 32 formed in a center of the mold 2 is further provided.

As illustrated in FIG. 1, an upper side of the lower die 22 is formed so as to form a shape of an outer side surface of a disc of a tire wheel, and a center portion of the lower die 22 protrudes to forma lower surface of the hub hole forming portion 32. Further, cooling means (not shown) is provided in an inside of the lower die 22, and can cool the molten metal 7 at the time of molding. The side die 24 has such a substantially cylindrical shape that its inner periphery forms a shape of an outer peripheral surface of a rim of a tire wheel, and the side die 24 is divided into four members approximately equally. A lower portion of the side die 24 abuts on an outer periphery of the lower die 22 and is fixed thereto.

As illustrated in FIG. 1, the ladle 5 includes a storing section 52 formed into a cup-like shape capable of storing the molten metal 7 when the mold 2 assumes the laid state, and the opening/closing body 51 which is slidably mounted to the upper surface of the middle die 23 of the mold 2 and has an injection port 53 capable of being aligned with the pouring gate 8. The storing section 52 includes a heat insulating layer 54 formed on its inner surface to prevent reduction in temperature of the molten metal 7. The mold 2 is tilted from the laid state to the standing state under a state in which the molten metal 7 is stored in the storing section 52, and thus the molten metal 7 in the ladle 5 can be poured from the injection port 53 into the pouring gate 8.

Figure 9:
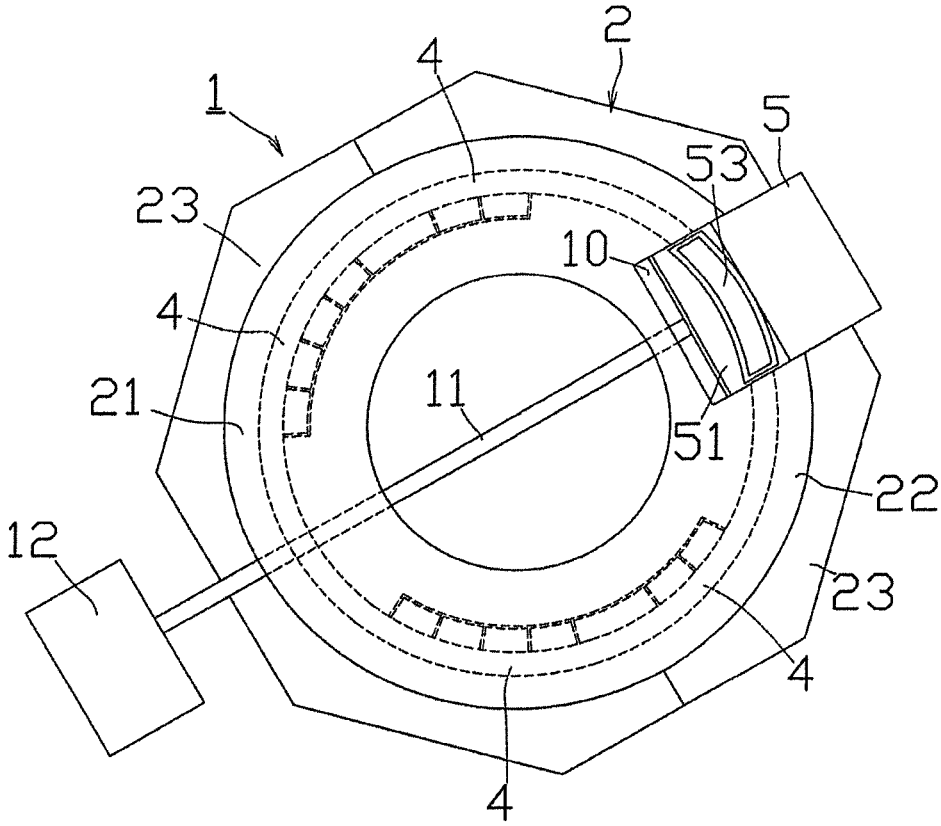
FIG. 9 is a top view illustrating the tilt type gravity molding device in the standing state.
Figure 10:
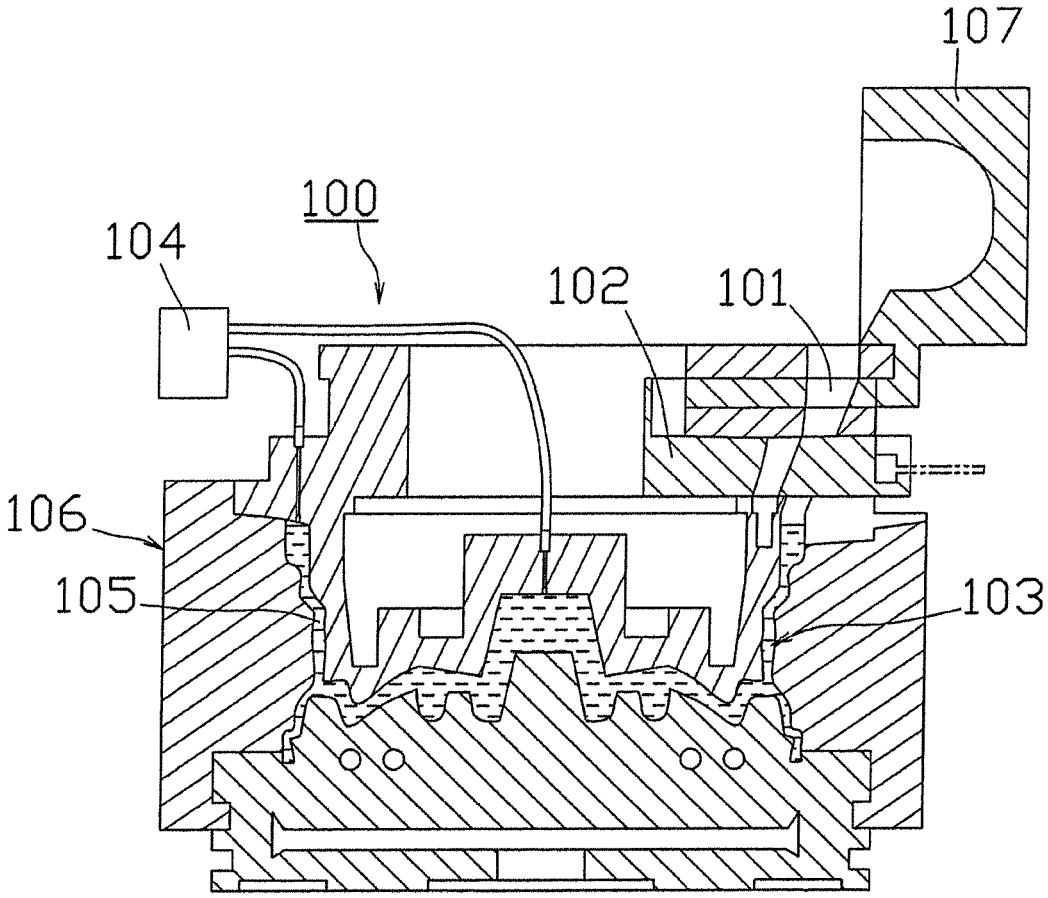
FIG. 10 is a view illustrating an example of a related-art tilt type gravity molding device.

As illustrated in FIGS. 1 and 7, a connecting section 11 extending from an opening/closing hydraulic jack 12 is connected to the opening/closing body 51 of the ladle 5. The opening/closing body 51 horizontally slides along the slide groove 10 of the middle die 23 by movement of the opening/closing hydraulic jack 12, to thereby open/close the pouring gate 8. As illustrated in FIGS. 1 and 9, the opening/closing body 51 has a plate-like shape having the injection port 53 passing through the opening/closing body 51 substantially in the up-and-down direction. The connecting section 11 has an elongated and columnar shape. One end of the connecting section 11 is formed to be connectable to the opening/closing hydraulic jack 12, and the other end thereof is fixed to the opening/closing body 51. The connecting section 11 is arranged between the upper die 21 and the middle die 23 so as to be slidable in a longitudinal direction.

Figure 2:
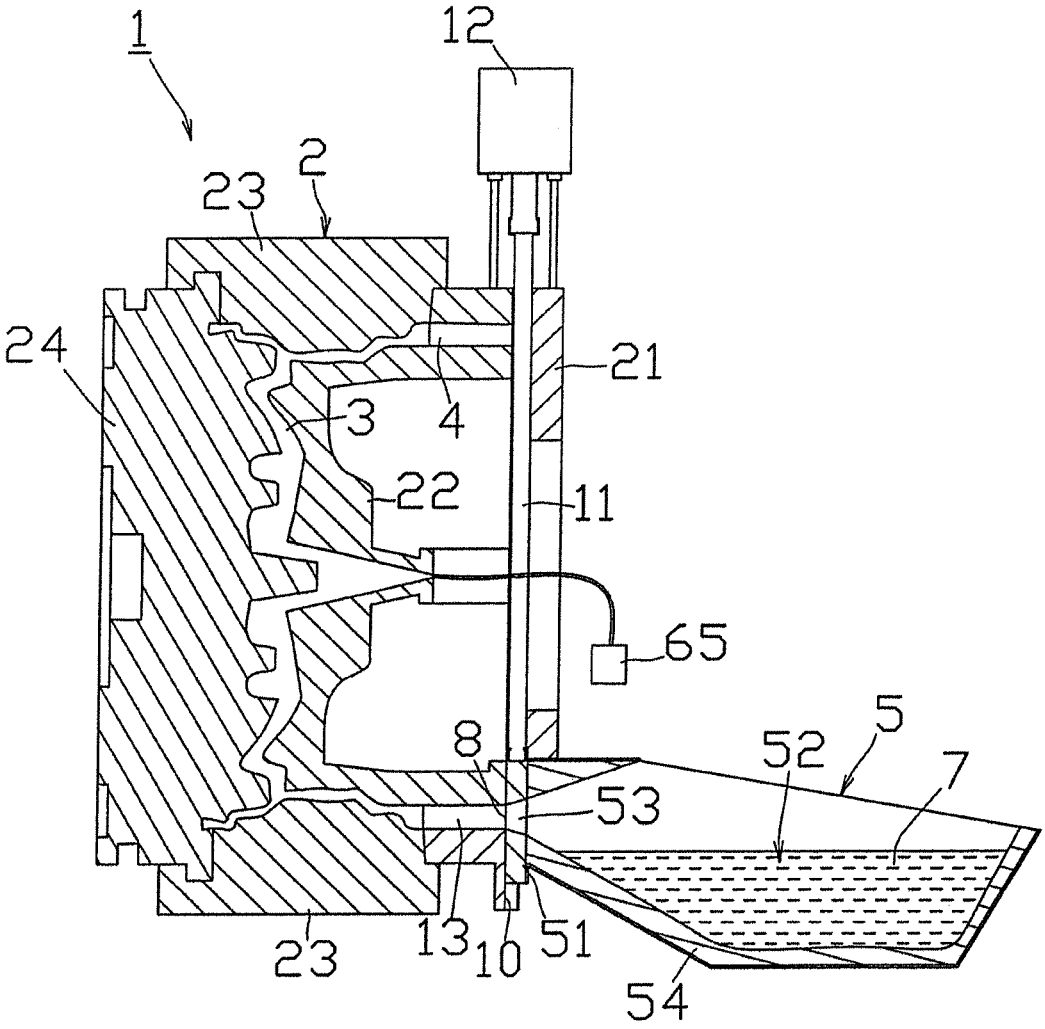
FIG. 2 is a sectional view illustrating a configuration of the tilt type gravity molding device in a laid state in which a molten metal is stored in a storing section of a ladle.

When forming the molded product 9 using the tilt type gravity molding device 1 constructed as described above, as illustrated in FIG. 2, first, the hydraulic jack (not shown) is controlled to keep the mold 2 in the laid state. In this case, the laid state refers to a state in which the mold 2 is tilted to cause a portion provided with the pouring gate 8 to be open sideways, and the mold 2 is kept so as to position the pouring gate 8 below the product forming space 3. At this time, the opening/closing body 51 of the ladle 5 is kept in an opening state of opening the pouring gate 8. Next, the molten metal 7 formed of an aluminum alloy controlled at a predetermined temperature is poured using a dipper (not shown) into the storing section 52 of the ladle 5, and thus the molten metal 7 is stored.

Figure 3:
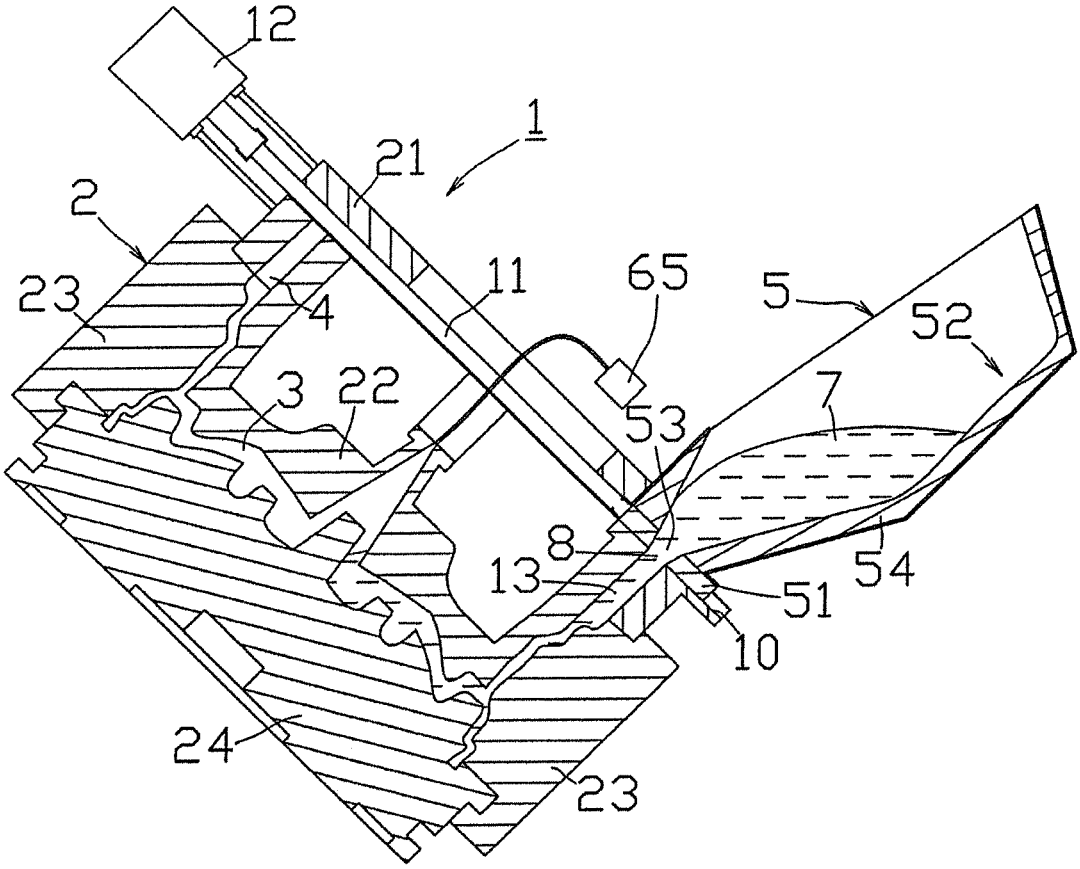
FIG. 3 is a sectional view illustrating the tilt type gravity molding device in the middle of tilting.
Figure 4:
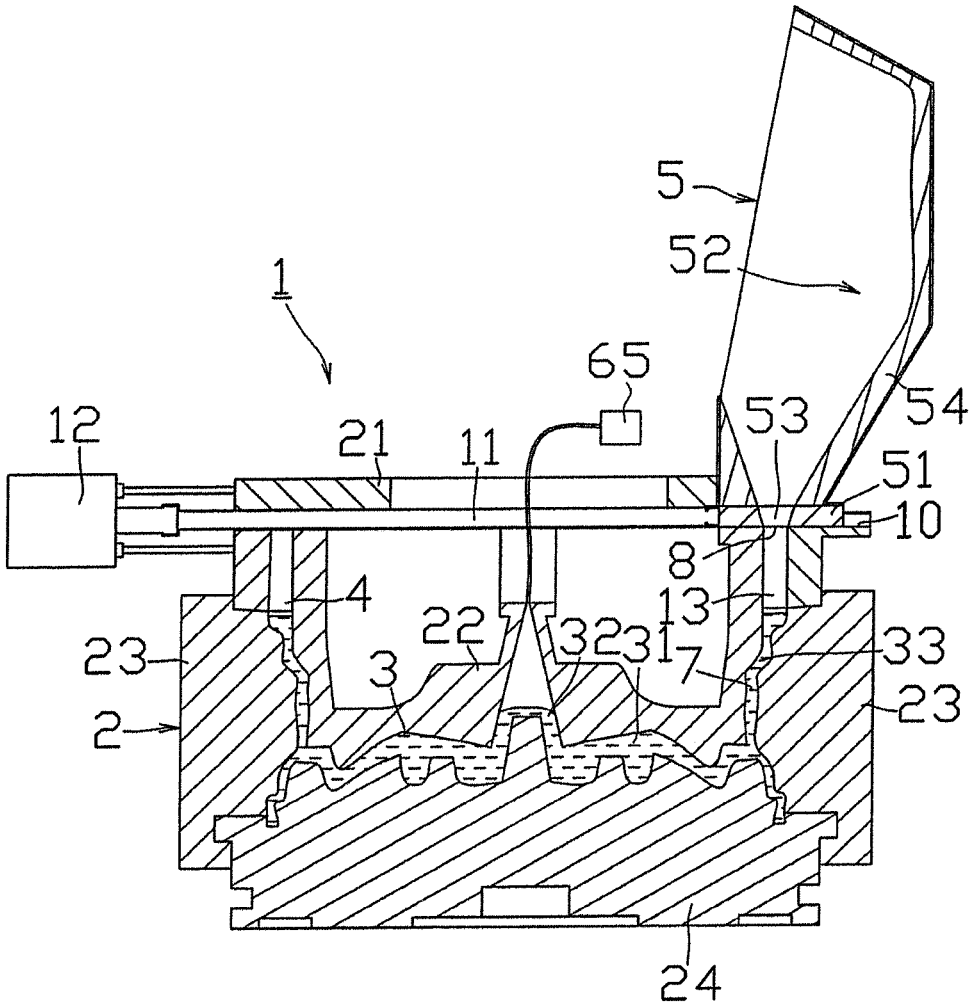
FIG. 4 is a sectional view illustrating a configuration of the tilt type gravity molding device in the standing state after pouring the molten metal.

Next, the tilting device (not shown) is controlled, and as illustrated in FIG. 3, the mold 2 is gradually tilted to the standing state. The molten metal 7 stored in the storing section 52 of the ladle 5 is poured from the injection port 53 into the pouring gate 8, and poured through a sprue runner 13 into the product forming space 3. At this time, the pump 61 and the center pump 65 are driven so as to suck the air contained in the upper space 4 of the product forming space 3, and thus a flow of the molten metal is smoothed. When the mold 2 assumes the standing state, as illustrated in FIG. 4, the molten metal 7 fills the product forming space 3.

Figure 5:
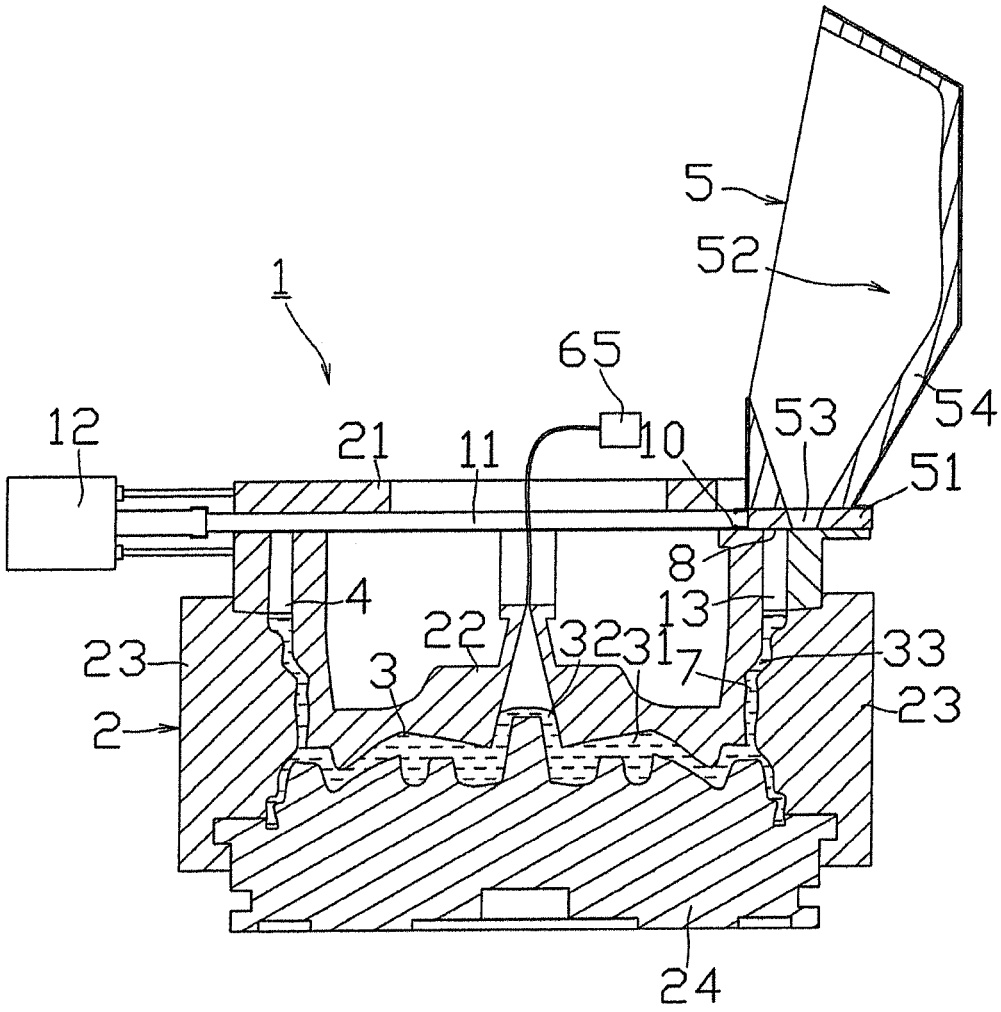
FIG. 5 is a sectional view illustrating a configuration of the tilt type gravity molding device in a state in which an opening/closing body is slid and a pouring gate is closed.

Next, as illustrated in FIG. 5, the opening/closing hydraulic jack 12 is controlled to cause the opening/closing body 51 to slide, and the pouring gate 8 is closed by misaligning the injection port 53 of the opening/closing body 51 and the pouring gate 8. Then, the high-pressure gas is introduced by the pump 61 into the introducing passage 63, and the high-pressure gas is supplied via the supplying passage 64 into the upper space 4 of the product forming space 3. Further, the high-pressure gas is supplied by the center pump 65 also into the hub hole forming portion 32. The cooling means (not shown) provided in the lower die 22 is actuated to cool the molten metal 7 in the product forming space 3, to thereby solidify the molten metal 7.

When the molten metal 7 is cooled and solidified, the hydraulic jack (not shown) is controlled to move away the upper die 21 and the middle die 23 upward, and to move away the members of the side die 24 in four directions. Then, the molded product 9 is removed from the lower die 22, and the product is obtained.

As described above, according to the tilt type gravity molding device 1 of this embodiment, by supplying the high-pressure gas, the molten metal 7 contained in the product forming space 3 can be pressurized by the gas, and hence no riser needs to be provided. Therefore, a molding time period can be shortened by a period of time of cooling and solidifying the riser, which can reduce manufacturing cost of the product. Further, it is possible to reduce an amount of the molten metal for forming the riser, cost of melting, and process cost of cutting the riser.

In addition, the opening/closing body 51 capable of sliding on the mold 2 is provided to the ladle 5. Thus, it is possible to simplify structure of opening/closing the pouring gate 8, and to suppress occurrence of clogging of the molten metal. Further, compared with a case of separately providing a device of closing the sprue runner, a length of the sprue runner 13 can be reduced. Thus, it is possible to prevent reduction in temperature of the molten metal 7, and to further facilitate temperature control of the molten metal 7. In addition, the sprue runner 13 is reduced in length. Thus, the molten metal 7 can be prevented from remaining in the sprue runner 13, and the amount of the molten metal 7 can be controlled easily.

The gas is supplied through the supplying passage 64 from the horizontal direction into the upper space 4 of the product forming space 3, and hence the gas is not jetted directly to the molten metal 7 stored in the product forming space 3. In addition, the supplying passage 64 branches into the plurality of passages, and hence the gas is not concentrated on one point. As a result, it is possible to effectively prevent the dent of the molten metal 7 that may be caused by jetting of the gas.

Note that, it is to be understood that the embodiment of the present invention is not limited to the above-mentioned embodiment and may be modified as appropriate without departing from the scope and spirit of the present invention.

INDUSTRIAL APPLICABILITY

The gravity molding device 1 according to the present invention can be suitably used as a molding device for molding, for example, a molded product formed of an aluminum alloy.

REFERENCE SIGNS LIST

1 tilt type gravity molding device
2 mold
3 product forming space
4 upper space
5 ladle
6 gas supplying section
7 molten metal
8 pouring gate
9 molded product
51 opening/closing body
52 storing section
53 injection port

The invention claimed is:

1. A tilt gravity molding device, comprising:
a mold having defined therein a product forming space for forming a molded product, and configured to receive a molten metal from a pouring gate;
a ladle comprising:
a storing section formed into a cup-like shape capable of storing the molten metal therein and abutting on a plate-like opening/closing body; and
the plate-like opening/closing body abutting on the mold, and having an injection port capable of being aligned with the pouring gate; and
a gas supplying section for supplying gas into the product forming space, comprising:
a pump for supplying high-pressure gas into a gas passage; and
the gas passage through which the high-pressure gas flowing from the pump is introduced into an upper space of the product forming space defined inside of the mold; and
a tilting device for tilting the mold;
wherein the tilt gravity molding device defines, by tilting the ladle together with the mold, the molten metal stored in the ladle is poured into the mold through the pouring gate;
wherein the ladle is slidably mounted to the mold, and is slidable between an opening state in which the injection port is aligned with the pouring gate, and a closing state in which the plate-like opening/closing body closes the pouring gate; and
wherein the high-pressure gas is supplied, after the molten metal fills the product forming space, by the gas supplying section into the upper space of the product forming space.

2. A tilt gravity molding device according to claim 1,
wherein the gas passage is horizontally communicated to the upper space.

3. A tilt gravity molding device according to claim 2, wherein the gas passage comprises:
an introducing passage through which the gas is introduced from the outside of the mold, the introducing passage being communicated to the outside of the mold; and
a supplying passage through which the gas is supplied into the upper space of the product forming space, the supplying passage branching from the introducing passage.

4. A tilt gravity molding device according to claim 1,
wherein the pump in the gas supplying section can apply pressure to the high-pressure gas into the gas passage, and can apply negative pressure by sucking the gas contained in the gas passage; and
wherein the pump sucks the air contained in the upper space of the product forming space when the molten metal stored in the storing section of the ladle is poured from the pouring gate into the product forming space.

5. A tilt gravity molding device according to claim 4, wherein the gas passage is horizontally communicated to the upper space.

6. A tilt gravity molding device according to claim 5, wherein the gas passage comprises:
an introducing passage through which the gas is introduced from the outside of the mold, the introducing passage being communicated to the outside of the mold; and
a supplying passage through which the gas is supplied into the upper space of the product forming space, the supplying passage branching from the introducing passage.

* * * * *